US009095970B2

(12) United States Patent
Purnomohadi et al.

(10) Patent No.: US 9,095,970 B2
(45) Date of Patent: Aug. 4, 2015

(54) MULTIPURPOSE TOOL CONFIGURED TO FACILITATE ACCESS TO INDIVIDUAL TOOL MEMBERS

(75) Inventors: Andro Purnomohadi, Vancouver, WA (US); Benjamin C. Rivera, Lake Oswego, OR (US); Blair Scott Barnes, Portland, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 804 days.

(21) Appl. No.: 12/972,251

(22) Filed: Dec. 17, 2010

(65) Prior Publication Data

US 2012/0151681 A1 Jun. 21, 2012

(51) Int. Cl.

| | |
|---|---|
| ***B25B 7/22*** | (2006.01) |
| ***B25F 1/00*** | (2006.01) |
| ***B25F 1/02*** | (2006.01) |
| ***B25F 1/04*** | (2006.01) |

(52) U.S. Cl.
CPC . *B25F 1/003* (2013.01); *B25B 7/22* (2013.01); *B25F 1/02* (2013.01); *B25F 1/04* (2013.01)

(58) Field of Classification Search
CPC ..... B25F 1/003; B25F 1/02; B25F 1/04; B26B 11/001; B26B 11/003; B25B 7/22
USPC ..... 7/128, 127, 125, 118
See application file for complete search history.

(56) References Cited

U.S. PATENT DOCUMENTS

| | | | | |
|---|---|---|---|---|
| 6,047,426 | A | 4/2000 | McIntosh et al. | |
| 6,098,225 | A | 8/2000 | McIntosh et al. | |
| 6,226,822 | B1 | 5/2001 | Chen | |
| 6,389,626 | B1 * | 5/2002 | Hung | 7/128 |
| 6,408,522 | B2 * | 6/2002 | Rivera | 30/155 |
| 6,694,558 | B2 * | 2/2004 | Ping | 7/128 |
| 7,080,423 | B2 * | 7/2006 | Seber et al. | 7/128 |
| 7,415,745 | B2 * | 8/2008 | Rivera | 7/128 |
| 2007/0022849 | A1 * | 2/2007 | Poehlmann | 81/427.5 |

OTHER PUBLICATIONS

Patent Examination Report for Australian Application No. 2011253766 dated Sep. 25, 2013.

* cited by examiner

*Primary Examiner* — Bryan R Muller
(74) *Attorney, Agent, or Firm* — Alston & Bird LLP

(57) ABSTRACT

A multipurpose tool is provided that is configured to provide ready access to individual tool members. In this regard, the tool may facilitate the identification and selection of a respective tool member and the subsequent unfolding of the tool member. The tool is also provided that has a structurally secure guard for one or more of the tool members, such as a knife blade.

7 Claims, 11 Drawing Sheets

MULTIPURPOSE TOOL CONFIGURED TO FACILITATE ACCESS TO INDIVIDUAL TOOL MEMBERS

FIELD

Embodiments of the present invention relate generally to tools and, more particularly, to a tool, such as a multipurpose tool, configured to facilitate access to individual tool members and a tool, such as a multipurpose tool, that includes a structurally secure guard for one or more of the tool members.

BACKGROUND

Multipurpose tools are widely popular for their utility in a substantial number of different applications. As its name suggests, a multipurpose tool includes a number of tool members carried by common frame. A multipurpose tool may include different combinations of tool members depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tool members that are useful for the intended application. For example, multipurpose tools may be specifically designed for automobile repairs, hunting, fishing or other outdoor applications, gardening, and the like.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool.

As multipurpose tools are frequently carried by users in the field, it is desirable for the multipurpose tools to be relatively small and lightweight while remaining rugged so as to resist damage. In order to reduce the overall size of a multipurpose tool, some multipurpose tools have been designed to be foldable. In this regard, foldable multipurpose tools are designed to move between a closed position and an open position. Generally, the closed position is more compact with the multipurpose tool frequently being carried in the closed position. Conversely, while the open position is generally less compact than the closed position, the open position generally allows the deployment of one or more of the tool members that are stowed and relatively inaccessible when the multipurpose tool is in the closed position.

For example, a multipurpose tool may include pliers or scissors having a pair of jaws connected to respective handles. In the open position, the pliers or scissors are deployed and capable of being actuated by movement of the handles toward and away from one another. In the closed position, the handles may be folded about the pliers or scissors such that the pliers or scissors are no longer functional. In the closed position, however, the multipurpose tool is more compact with the form factor generally defined by the proximal relationship of the handles. The pliers or scissors may be spring-actuated to assume an open position in the absence of any forces applied by a user who moves the handles toward one another and, in turn, move the pliers or scissors to a closed position. Over time and with repeated movement between the open and closed positions, the spring that biases the pliers or scissors toward an open position may disadvantageously become worn such that the bias force provided by the spring is reduced or break.

A multipurpose tool may include handles designed such that one or more tool members are disposed within the handles when not in use. By being stored within the handles, the form factor of the multipurpose tool may be relatively small in comparison to the number of tool members carried by the multipurpose tool. As such, the multipurpose tool may have substantial utility and versatility, albeit in a relatively small tool. To access a tool member that is stored within a handle, a user may engage the tool member and may unfold the tool member such that the tool member is operational. As a number of tool members may be folded into the handles and since the visibility of the tool members within the handle is relatively limited, it may be difficult to identify a particular tool member relative to the other tool. Because of the limited space available within the handles, it may also be difficult to engage a particular one of the tool members in an effort to unfold or open the tool member.

BRIEF SUMMARY

According to embodiments of the present invention, a tool, such as a multipurpose tool, is provided that is configured to provide improved access to individual tool members. In this regard, the tool of one embodiment may facilitate the identification and selection of a respective tool member and the subsequent unfolding of the tool member. In another embodiment, a tool may be provided that has a more structurally secure guard for one or more of the tool members.

In one embodiment, a multipurpose tool is provided that has a plurality of handles configured for relative movement between a closed position and an open position. The plurality of handles include a first handle having opposed sidewalls and a floor extending between the opposed sidewalls. The multipurpose tool of this embodiment also includes a plurality of tool members carried by at least a first handle and foldable into the first handle such that the tool members are configured for movement through a first open side of the first handle, opposite the floor, between a stowed position and an open position. The plurality of tool members are disposed alongside one another in a stowed position so as to define a composite tool profile. In accordance with this embodiment, the floor of the first handle includes a web extending between the opposed sidewalls and defines an opening having a shape that corresponds to the composite tool profile. The opening may be sized, for example, to be at least as large as the tool members. As such, a user may begin to unfold a tool member by initially pushing the tool member through the opening until the tool member extends beyond the handle and may be grasped by the user and more fully unfolded.

A multipurpose tool of one embodiment may include first and second jaws rotatably connected to the first and second handles, respectively, and a spring positioned between the first and second jaws and configured to bias the jaws into an open position. The spring may be positioned so as to be visible and accessible in an instance in which the first and second handle are in the open position. The multipurpose tool of another embodiment includes first and second jaws rotatably connected to the first and second handles, respectively, with the first and second jaws each including respective eccentric cam members. The multipurpose tool may also include first and second springs carried by the first and second handles, respectively, that ride upon the eccentric cam members of the first and second jaws, respectively. The eccentric cam members of the first and second jaws may each have a first portion that the first and second springs ride upon as the first and second handles transition from the closed position to the open position and a second portion having at least one of a different shape or a different size than the first portion with the first and second springs riding upon the second portion as the first and second handles reach the open position.

In accordance with another embodiment, a multipurpose tool is provided that includes a plurality of handles configured for relative movement between a closed position and an open position. The plurality of handles include a first handle defining a longitudinally extending axis. The multipurpose tool also includes a plurality of tool members carried by at least a first handle and foldable into the first handle. Each tool member of this embodiment includes a designation representative of the respective tool member. The designations of the tool members are differently positioned along the longitudinally extending axis. At least one of the tool members may define a notch aligned along the longitudinally extending axis with the designation of an adjacent tool member. Additionally or alternatively, the first handle may include a pair of opposed sidewalls that define a channel into which the plurality of tool members are foldable. In this embodiment, a sidewall of the first handle may define a window aligned along the longitudinally extending axis with the designation of at least one of the tool members. As such, a user may more confidently select a respective tool member from among the plurality of tool members folded into the handle based upon the designations carried by the tool members.

The plurality of handles may include a second handle, and the multipurpose tool may further include first and second jaws rotatably connected to the first and second handles, respectively, and a spring positioned between the first and second jaws and configured to bias the jaws into an open position. In this embodiment, the spring is positioned so as to be visible and accessible in an instance in which the first and second handle are in the open position.

In another embodiment in which the plurality of handles include a second handle, the multipurpose tool may further comprise first and second jaws rotatably connected to the first and second handles, respectively. The first and second jaws may each include respective eccentric cam members. The multipurpose tool may also include first and second springs carried by the first and second handles, respectively, that ride upon the eccentric cam members of the first and second jaws, respectively. The eccentric cam members of the first and second jaws may each have a first portion that the first and second springs ride upon as the first and second handles transition from the closed position to the open position and a second portion having at least one of a different shape or a different size than the first portion with the first and second springs riding upon the second portion as the first and second handles reach the open position.

In yet another embodiment, a tool is provided that includes a first handle having first and second sidewalls and a channel defined therebetween, a tool member attached to an exterior surface of the first sidewall of the first handle and foldable relative thereto between a closed position and an open position, and a guard operably connected to the first handle. The guard of this embodiment includes an upstanding portion and a laterally extending portion with the tool member disposed between the first sidewall of the first handle and the guard in an instance in which the tool member is in the closed position. A distal edge of the laterally extending portion of the guard of this embodiment extends at least to an inner surface of the first sidewall of the first handle proximate the channel. In one embodiment, the distal edge of the laterally extending portion of the guard is aligned with the inner surface of the first sidewall of the first handle proximate the channel. As a result, the guard may be more securely affixed to the handle.

The tool of one embodiment is a multipurpose tool that also includes a second handle configured for relative movement with the first handle between a closed position and an open position, first and second jaws rotatably connected to the first and second handles, respectively, and a spring positioned between the first and second jaws and configured to bias the jaws into an open position. The spring may be positioned so as to be visible and accessible in an instance in which the first and second handle are in the open position.

The tool of another embodiment is a multipurpose tool that also includes a second handle configured for relative movement with the first handle between a closed position and an open position, and first and second jaws rotatably connected to the first and second handles, respectively, with the first and second jaws including respective eccentric cam members. The multipurpose tool of this embodiment also includes first and second springs carried by the first and second handles, respectively, that ride upon the eccentric cam members of the first and second jaws, respectively. The eccentric cam members of the first and second jaws may each have a first portion that the first and second springs ride upon as the first and second handles transition from the closed position to the open position and a second portion having at least one of a different shape or a different size than the first portion with the first and second springs riding upon the second portion as the first and second handles reach the open position.

BRIEF DESCRIPTION OF THE SEVERAL VIEWS OF THE DRAWING(S)

Having thus described embodiments of the invention in general terms, reference will now be made to the accompanying drawings, which are not necessarily drawn to scale, and wherein:

Figure 15:
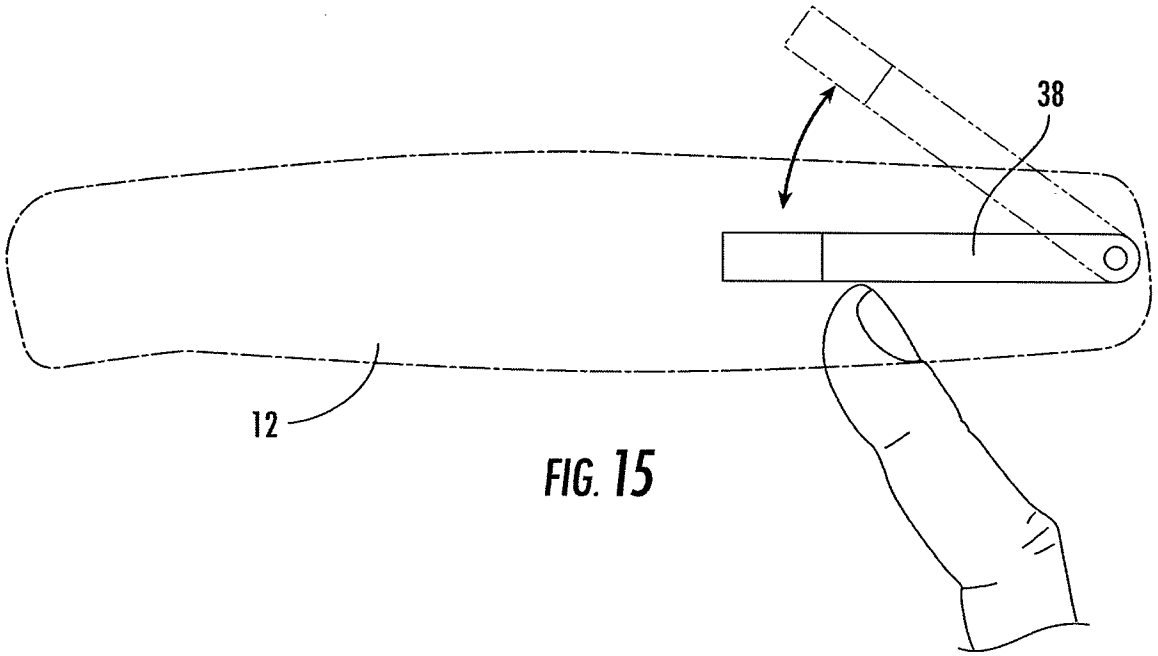
Figure 16:
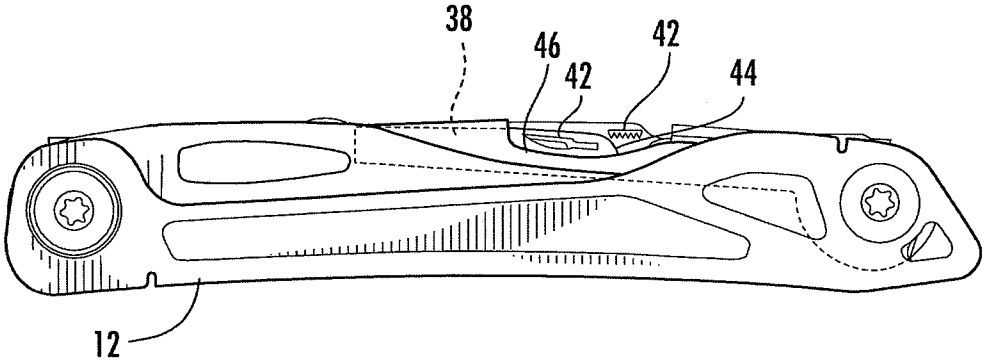

FIG. 15 is a schematic representation of a user forcing a tool member from the channel of a handle by inserting a finger through the opening defined by the floor of the handle in accordance with one embodiment of the present invention; and FIG. 16 is a side view illustrating a handle and a plurality of tool members disposed within a channel defined by the handle and having icons or other designations that identify the respective tool members in accordance with one embodiment of the present invention.

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIGS. 1-8, a tool, such as a multipurpose tool 10, according to one embodiment of the present invention is depicted. While the tool will be described in the context of a multipurpose tool, other types of tools may readily employ embodiments of the present invention including knives and other tools that are not considered multipurpose tools. For purposes of illustration, but not of limitation, a multipurpose tool employing an embodiment of the present invention will now be described.

The multipurpose tool 10 includes a plurality of handles 12 configured for movement relative to one another, as well a plurality of tool members carried by at least one of the handles. Typically, the multipurpose tool includes a pair of generally elongate handles that extend between opposed ends. As a result of their connection, such a pivotal connection, to one another and/or to one or more of the tool members, the handles can be moved toward and away from one another, such as in order to actuate a tool member as described below.

As also described below, the multipurpose tool 10 may be configured such that the handles 12 are adapted for relative movement between an open position as shown in FIGS. 1-4 and a closed position as shown in FIGS. 5-8 and discussed hereinafter. As will be apparent, the multipurpose tool has a compact form factor in the closed position so as to facilitate transport and storage of the multipurpose tool. While the multipurpose tool is more expansive in the open position, one or more of the tool members of the multipurpose tool are accessible and capable of being utilized in the open position, even though those same tool member(s) are stowed and generally inaccessible in the closed position.

Each handle 12 includes a pair of opposed sidewalls 12*a* and a floor 12*b* having a web interconnecting the opposed sidewalls such that a cavity is defined within the handle to receive and store a plurality of tool members. With reference to FIGS. 1-4, a multipurpose tool 10 of one embodiment may include first and second handles 12 that are connected to the opposed jaws 14 of a tool member 16 having pivotable jaws, such as the pliers of the illustrated embodiment. In the open configuration, the handles may be moved toward one another in order to close the jaws of the pliers and away from one another in order to open the jaws of the pliers. In one embodiment, the jaws of the pliers are configured to contact one another once the jaws are in a fully opened position in order to prevent further opening of the jaws. Even though the jaws cannot be opened any further, the handles can be pivoted relative to the respective jaws in order to transition from the open position as shown in FIGS. 1-4 to the closed position as shown in FIGS. 5-8.

Figure 2:
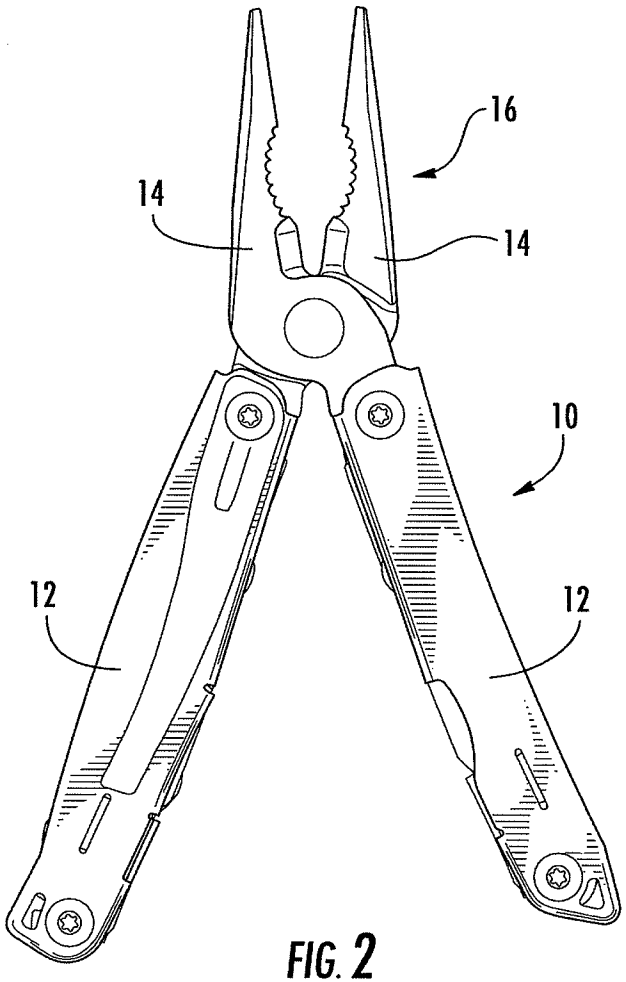
FIGS. 1 and 2 are views from opposite sides of a multipurpose tool according to an embodiment of the present invention in the open position.
Figure 1:
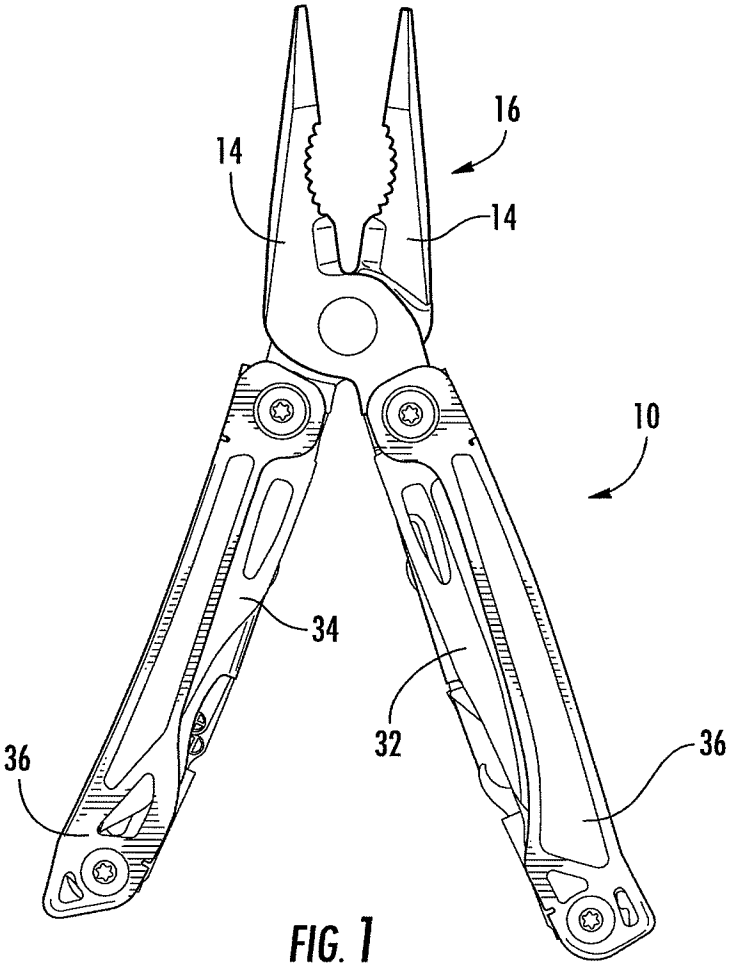
Figure 4:
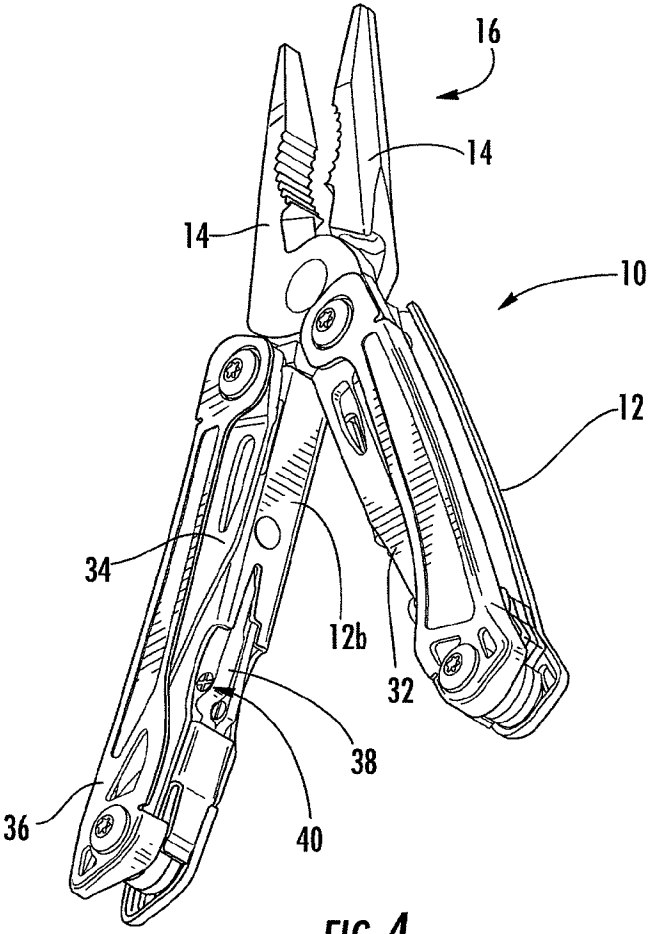
FIGS. 3 and 4 are perspective views of the multipurpose tool of FIG. 1 in the open position.
Figure 3:
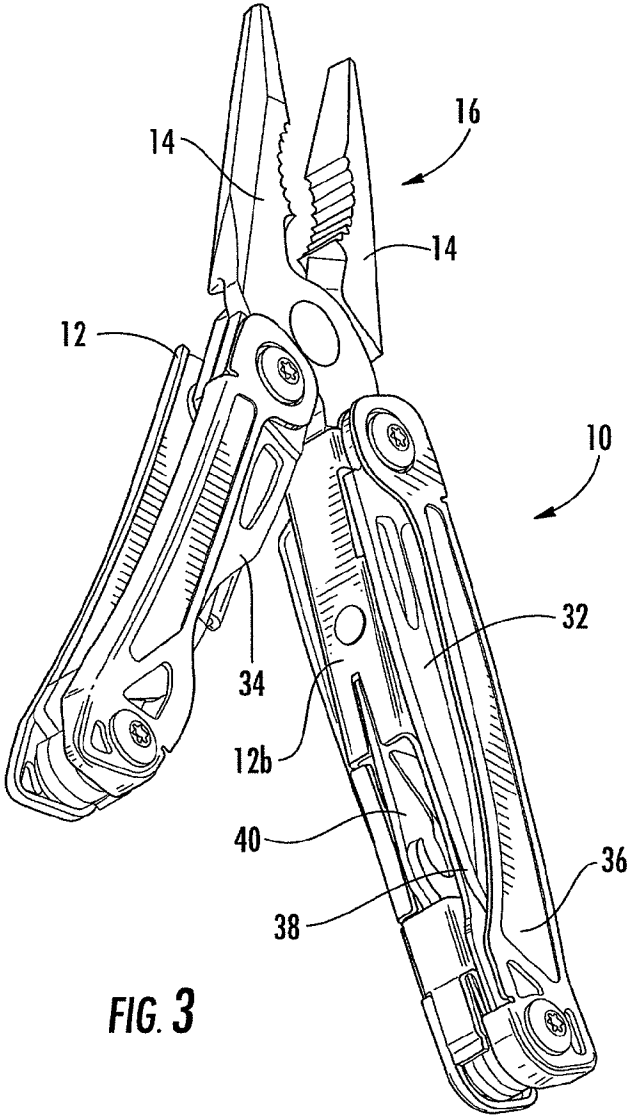
Figure 5:
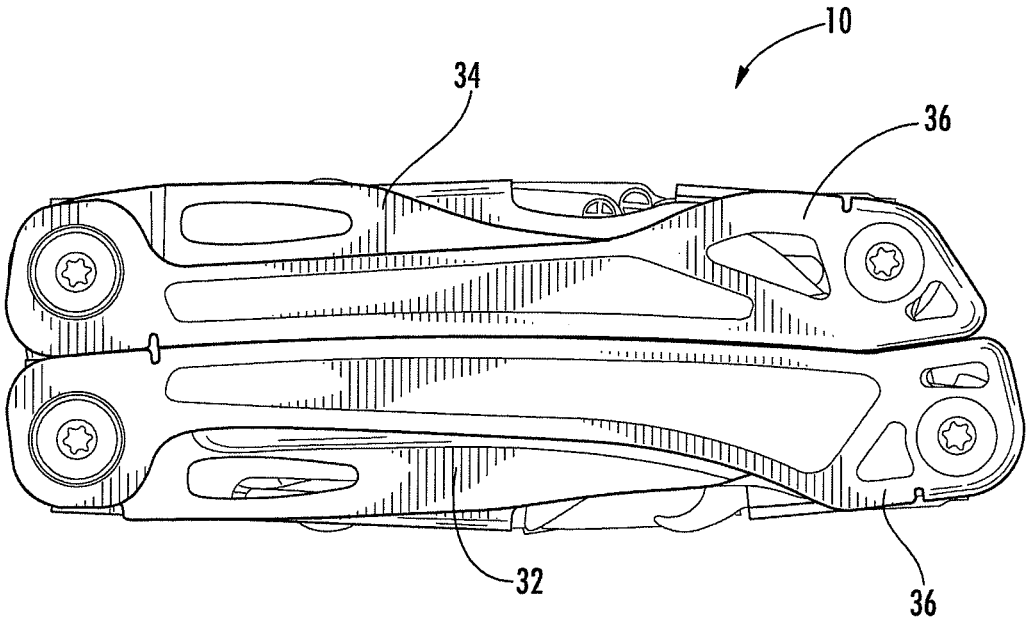
FIGS. 5 and 6 are views from opposite sides of a multipurpose tool according to an embodiment of the present invention in the closed position.
Figure 6:
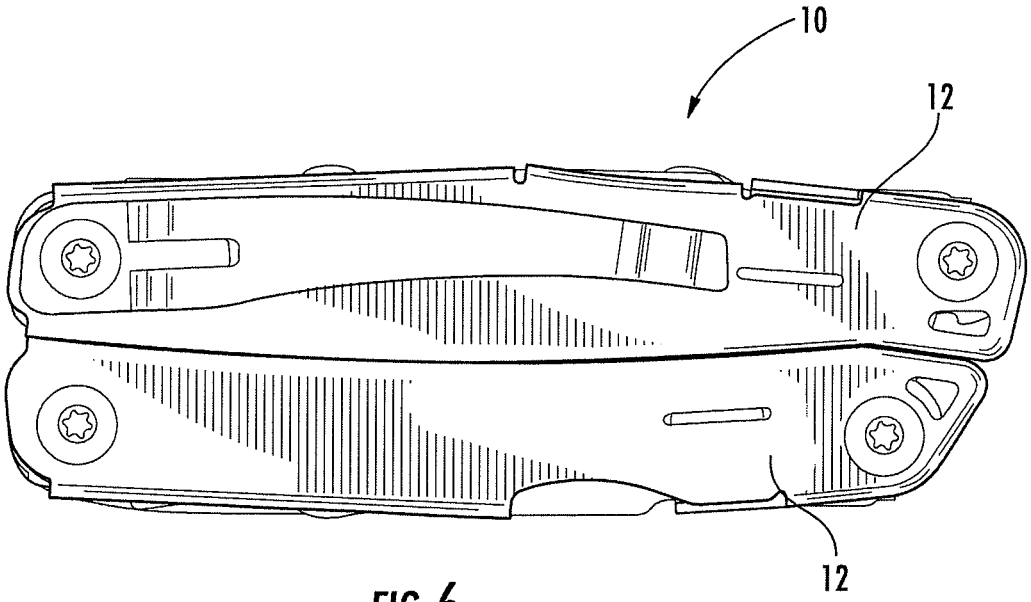
Figure 7:
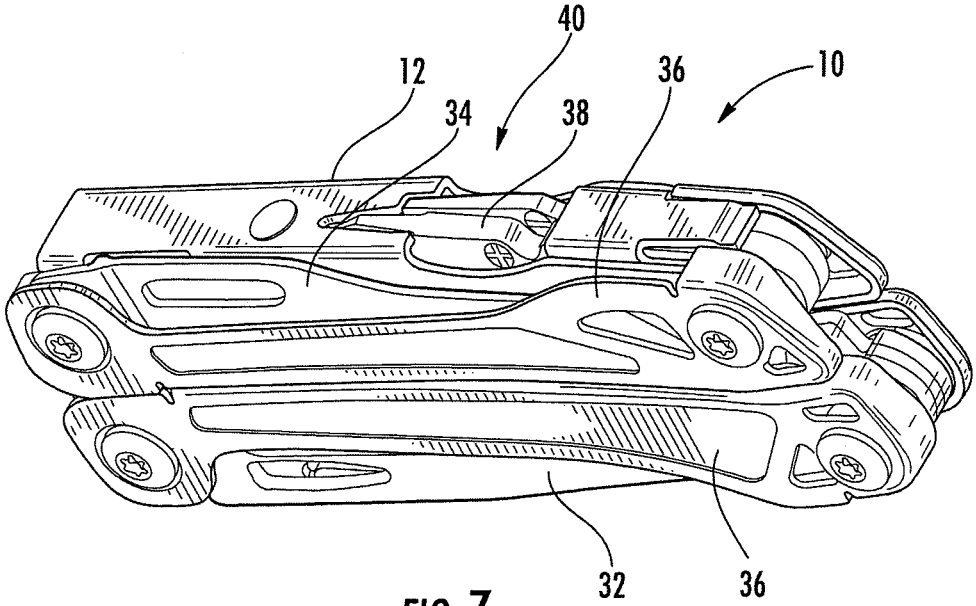
FIGS. 7 and 8 are perspective views of the multipurpose tool of FIG. 5 in the closed position.
Figure 8:
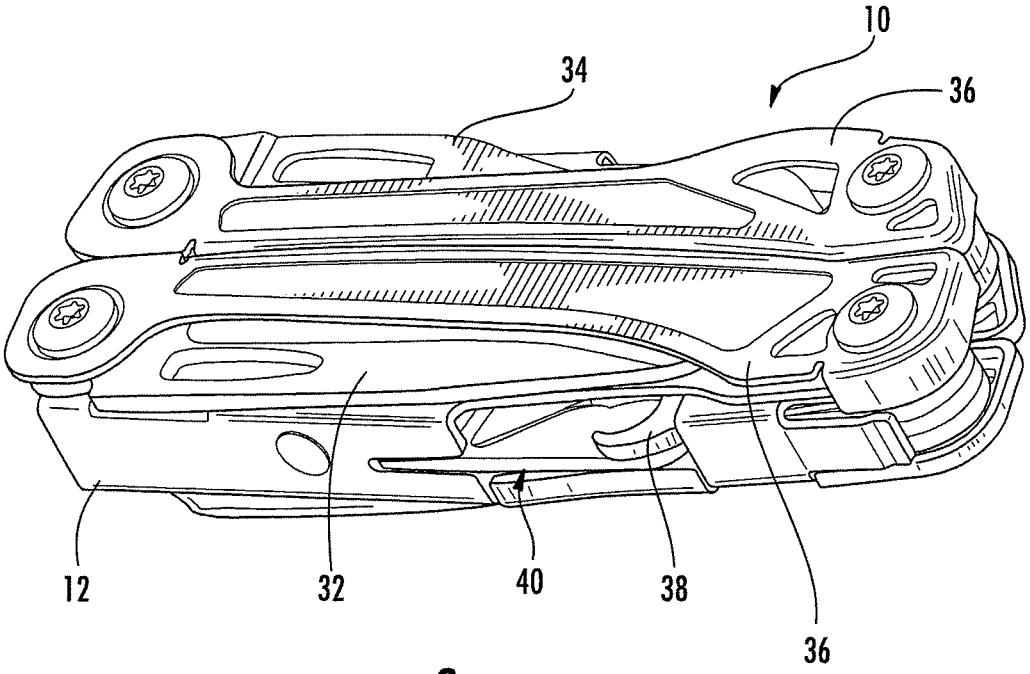
Figure 9:
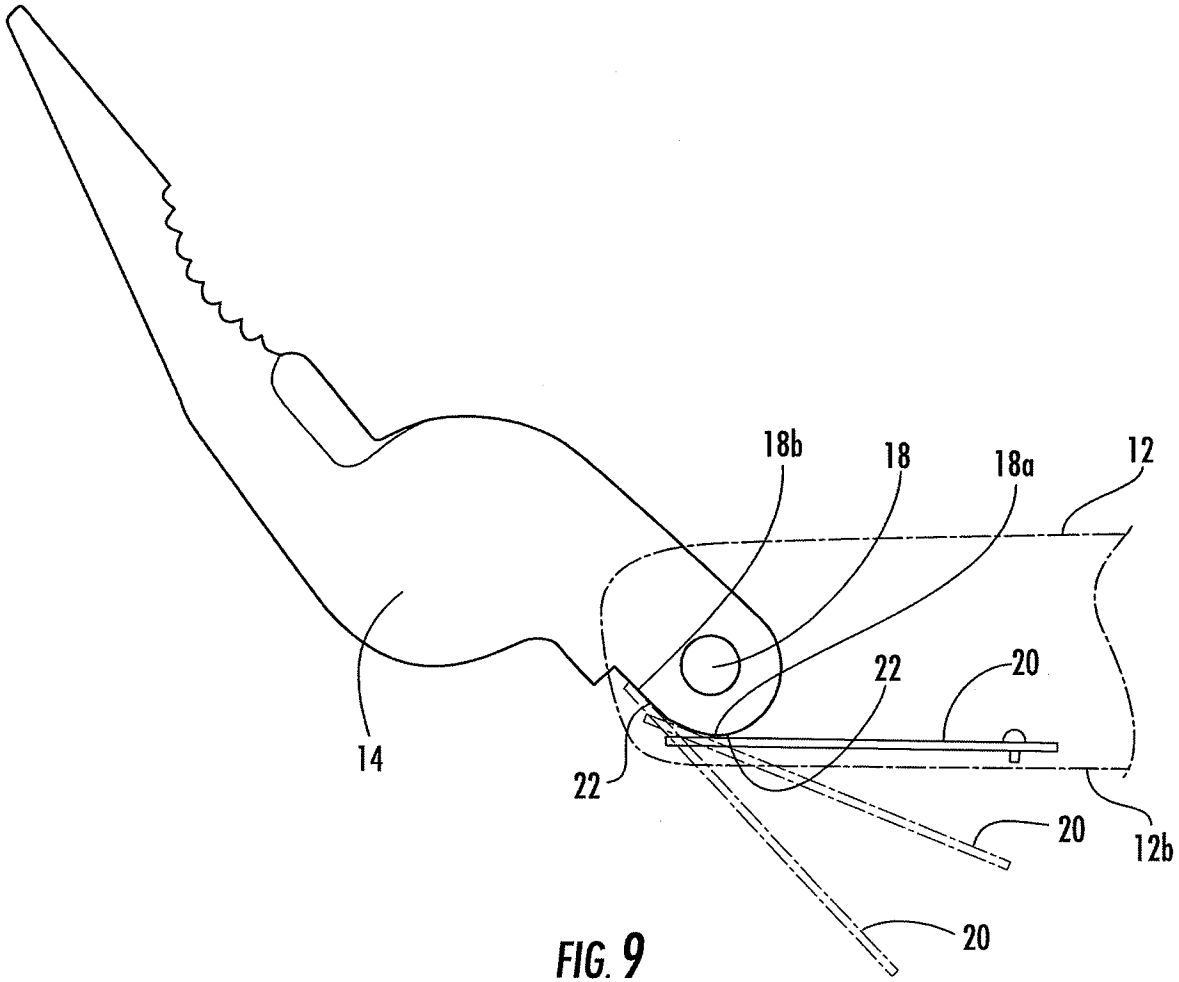
FIG. 9 illustrates interaction between a jaw and a spring carried by a handle of a multipurpose tool in accordance with one embodiment of the present invention.

Conversely, the handles 12 may transition from the closed position shown in FIGS. 5-8 to the open position shown in FIGS. 1-4 by pulling the handles away from one another and rotating the handles about the opposed jaws 14. The tool 10 may be configured to provide tactile feedback to a user indicating that the tool has been unfolded from a closed position to a fully open position. As shown in FIG. 9, the jaws of this embodiment may include or otherwise be connected to and move in concert with a cam member 18. Additionally, each handle may include a spring 20, such as a cantilever spring, disposed within the handle, such as by extending internally along the floor 12*b* of the handle. In this regard, FIG. 9 depicts the spring in each of three positions as the handle is rotated relative to the jaw from first and second transitional positions moving from a closed position to an open position to a third open position with the spring being shown in solid lines and the handle being shown in one of the positions in dashed lines. As shown, the spring has a distal end 22 that is biased into operable contact with the cam member.

In this embodiment, the cam member 18 may be eccentric. Indeed, the first portion 18*a* of the cam member that the distal end 22 of the spring 20 contacts and rides upon during the transition from a closed position to an open position may have a semicircular shape with a constant radius. Once the handles 12 are fully opened, however, the distal end of the spring moves into contact with a second portion 18*b* of the cam member that has a different size and/or shape. For example, the second portion of the cam member with which the distal end of the spring is in contact once the handles are fully opened may have a smaller radius and/or may have a different shape and/or size, such as by being linear or otherwise defining a smaller profile, than the remainder of the cam member. Thus, fully opening the handles and the corresponding manner in which the distal end of the spring rides upon or otherwise snaps into contact with the second portion of the cam member causes a user grasping the handles to experience tactile feedback such as a change in the resistance to opening or otherwise moving the handles. This tactile feedback may inform a user that the handles are fully open.

The eccentric cam member 18 may also create a differential in the force, such as an increase in the force, required to fold the handles 12 as the distal end 22 of the spring 20 transitions from the second portion 18*b* of the cam member to the larger semicircular first portion 18*a* of the cam member. As such, the increase in force required to fold the handles may decrease the likelihood that a user may inadvertently fold or close up the handles.

Figure 10:
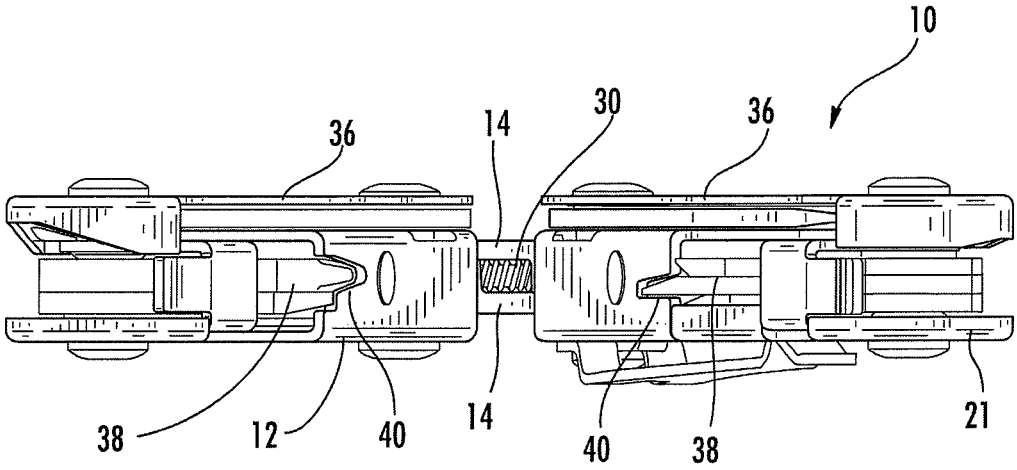
FIG. 10 is an end view of the multipurpose tool of FIG. 1 looking upwardly between the handles.
Figure 11:
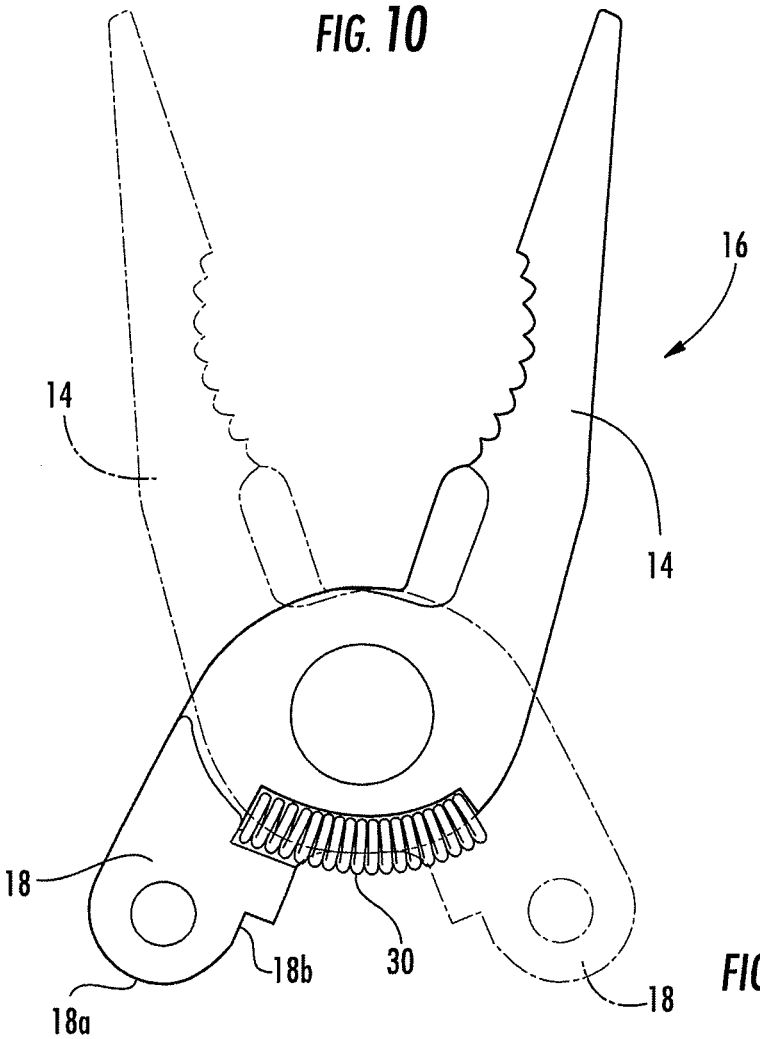
FIG. 11 illustrates interaction between the jaws and a spring disposed therebetween in accordance with one embodiment of the present invention and in which the upper jaw is shown in dashed lines for purposes of illustration.

The jaws 14 may be biased, such as to an open position. In this regard, a spring 30, such as a coil spring, may extend between base portions of the jaws, thereby biasing the jaws to be open in the absence of additional forces, as shown, for example, in FIGS. 10 and 11. In the illustrated embodiment, the jaws may be configured to define a pocket extending therebetween and externally accessible without having to disassemble the tool 10. As such, if the spring breaks or otherwise suffers degradation in its performance the spring may be removed, such as by compressing the spring with tweezers, a screwdriver, a knife blade or the like. Another spring, that is, a replacement spring, may than be installed.

In order to retain the spring 30, each jaw 14 may define a protrusion upon which a respective end of the spring may be seated. Thus, the spring may be maintained in position between the handles 12 until a user affirmatively removes the spring. By being able to access the spring, a spring that breaks or that otherwise suffers performance degradation, such as reduced spring forces, may be efficiently removed and replaced.

Figure 12:
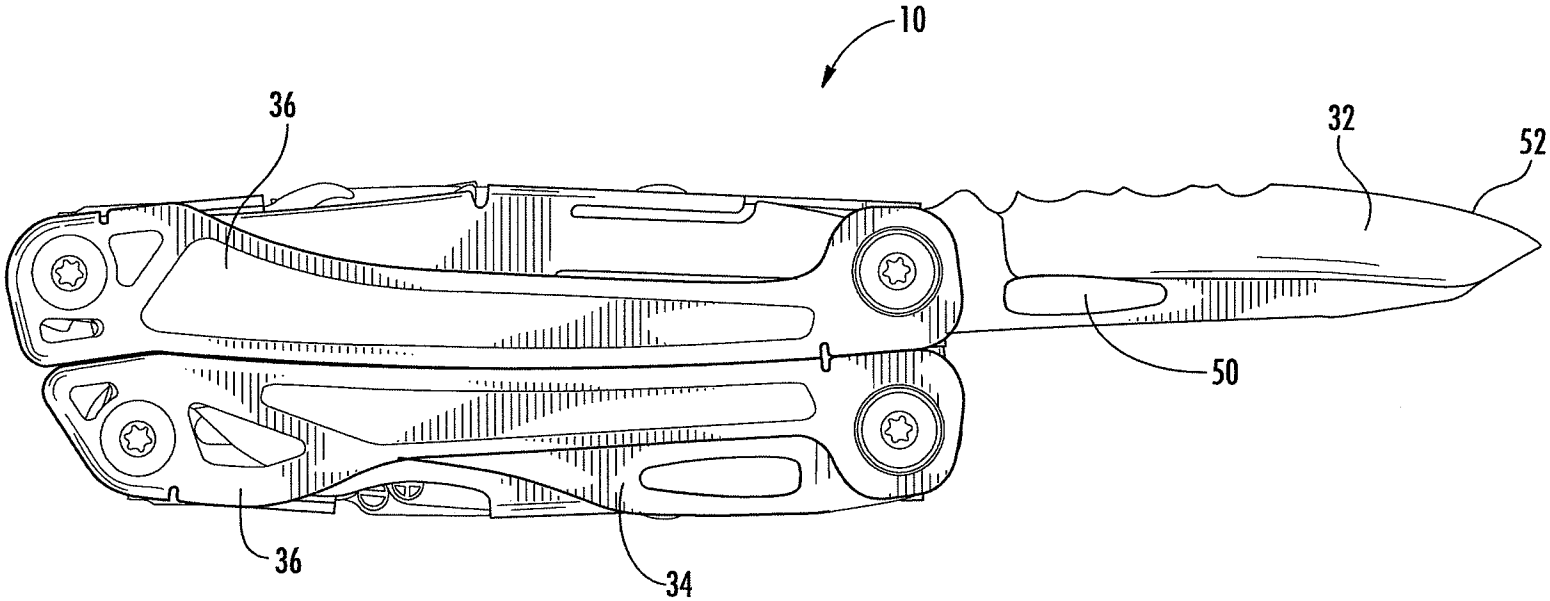
FIG. 12 is a side view of the multipurpose tool of FIG. 5 with the knife blade deployed.

The multipurpose tool 10 can include a variety of tool members. For example, the multipurpose tool can include a tool member 16 having pivotable jaws 14, such as the pliers described above. Although not heretofore described, the tool member having pivotable jaws can also include wire cutters and/or wire strippers, or scissors, if desired. Additionally, the multipurpose tool of the embodiment depicted in FIGS. 1-8 includes a knife blade 32 and a saw 34 carried by the handles 12. In this regard, the knife blade and the saw may be rotatably connected to the respective handles. The multipurpose tool may also include guards 36 operably connected to the handles with each guard defining a pocket with respect to a sidewall 12*a* of the respective handle within which the knife blade or saw may be stowed. As shown in FIG. 12 with respect to the knife blade, the knife blade (as well as the saw) can be unfolded to a deployed position as shown in FIG. 12, particularly in instances in which the multipurpose tool is in the closed configuration.

In order to facilitate the rotation of the knife blade 32 from its stowed position, the knife blade can define an opening 50, typically opposite the cutting edge 52, that a user can grasp in order to rotate the knife blade outwardly away from the handle 12. In order to prevent access to the cutting edge of the knife blade while the knife blade is in a folded position, the guard 36 that is attached or otherwise integral to the frame of the respective handle covers the cutting edge of the knife blade while the knife blade is in a folded position.

Figure 13:
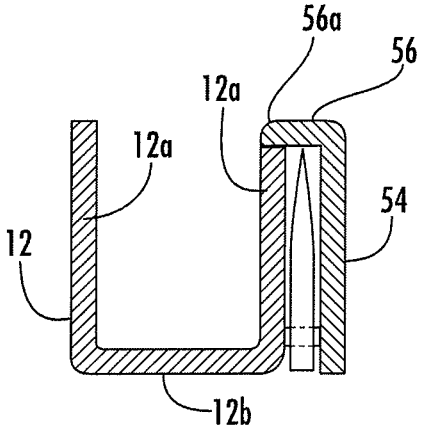
FIG. 13 is an illustration of the guard and the handle in isolation with the knife blade shown in dashed lines in accordance with one embodiment of the present invention.

In order to increase the stability and support of the guard 36, the guard may be configured to have an L-shape in cross-section with an upstanding portion 54 of the guard extending alongside the folded knife blade 32 in a generally parallel orientation relative to the sidewalls 12*a* of the handle 12. The guard of this embodiment may also include a laterally extending portion 56 that extends generally perpendicular to the sidewalls of the handle. In order to provide stability and support to the guard, the distal edge 56*a* of the laterally extending portion may overlap the sidewall and, in one embodiment, may extend laterally inward from the upstanding portion to at least the inner edge of the sidewall, that is, the edge of the sidewall proximate the channel as shown, for example, in FIG. 13, which illustrates the guard and the handle in isolation. For example, the distal edge of the laterally extending portion of the blade guard may be aligned with the inner edge of the sidewall of the handle. By overlapping the sidewall of the handle in this manner, the guard is more stable and secure.

Figure 14:
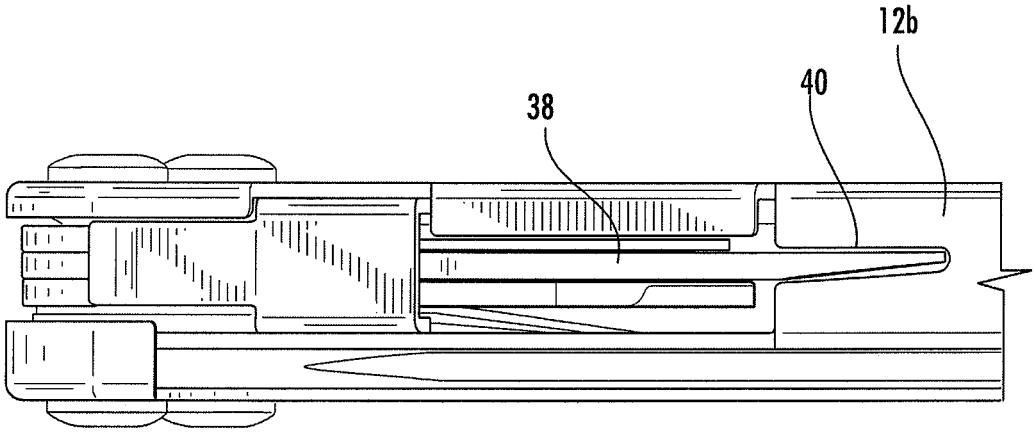
FIG. 14 illustrates the floor of a handle and the opening defined thereby in relation to the composite tool profile in accordance with one embodiment of the present invention.

The multipurpose tool 10 can also include additional tool members 38, such as a screwdriver, bit driver, bottle opener, can opener, saw, razor, gut hook or the like, that are folded into the channel defined by a handle 12. Although these tool members may include a nail nick to facilitate a user's interaction with and engagement of a tool member, the nail nicks may become worn or otherwise filled with residue over time such that the usefulness of the nail nick is reduced. In order to facilitate access to the tool members, the handle may define an opening 40 through which tool members are visible. For example, the floor 12*b* of the handle may include a web that extends between the opposed sidewalls 12*a*. The web may, in turn, define an opening through which tool members foldable within the respective handle are accessible, as shown in FIGS. 3, 4, 7 and 8. While the opening defined by the web may be differently sized and shaped, the opening may have the same general shape and the same or a slightly larger size than the tool members foldable into the handle. In this regard, the tool members may be disposed alongside one another in a stowed position within the handle so as to define a composite tool profile. As shown in FIG. 14, for example, the web of the floor of the handle may define an opening having a shape that corresponds to the composite tool profile.

In order to unfold a tool member 38, a user may insert a finger into the opening 40 and push or otherwise force a selected tool member outwardly from the handle 12, as shown in FIG. 15. While a user may not be able to fully unfold the tool member by force applied through the opening defined by the web of the floor 12*b*, the tool member may be advanced beyond the handle by a sufficient amount that a user may then grasp or otherwise engage the tool member so as to fully unfold the tool member.

Prior to unfolding a tool member 38 as described above, a user typically selects a particular tool member, as opposed to the other tool members similarly folded and stowed within the same handle 12. However, when the tool members are folded into a handle, a user may have difficulty in distinguishing a selected tool member from other tool members. In this embodiment, each tool member may include an icon or other designation 42 that identifies the respective tool member. The tool member may include the icon or other designation at various different positions, but the tool members of one embodiment include the icon or other designations along the spline of the respective tool member. Although the icon or other designation may be applied in various manners, the icon or other designation may be molded, etched or otherwise formed into the tool member, such as along the spline of the tool.

As tool members 38 that are folded into a handle 12 may lie side-by-side, the icons or other designations 42 carried by tool members may be staggered in a lengthwise direction as defined by the longitudinally extending axis of the handle. In addition, tool members that lie next to other tool members may define a notch 44 aligned axially, that is, along the longitudinal axis of the handle, with the position of the icon or other designation of the adjacent tool member, as shown in FIG. 16. Thus, icons or other designations of tool members may be visible through the notch(es) even when the tool is one of a plurality of tools that lie side-by-side. The handle may also define a window 46 aligned with an icons or other designations to permit the icons or other designations to be readily viewed. By considering the icon or designation, a user may have increased confidence that the correct tool member will be selected.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multipurpose tool comprising:

a plurality of handles configured for relative movement between a closed position and an open position, wherein the plurality of handles comprise a first handle defining a longitudinal axis between opposite ends of the first handle and comprising opposed sidewalls and a floor extending between the opposed sidewalls;

a plurality of tool members carried by at least a first handle and foldable into the first handle such that the tool members are configured for movement through a first open side of the first handle, opposite the floor, between a stowed position and an open position, wherein the plurality of tool members are disposed alongside one another in a stowed position so as to define a composite tool profile, wherein the floor of the first handle includes a web extending between the opposed sidewalls and at least partially defines an opening having a shape that corresponds to the composite tool profile so as to expose distal ends of two or more tools at respective distances from an end of the first handle, wherein the floor includes a first portion of the floor that extends between the opposed sidewalls on a first end of the plurality of tool members, the first portion including an edge facing the opening that is nonlinear and that defines at least one longitudinally extending notch configured to expose a respective tool member, wherein another handle component is disposed within the first handle and extends between the opposed sidewalls, the other handle component being disposed on a second end of the plurality of tool members, longitudinally opposite the first end, so as to cooperate with the first portion of the floor to define the opening having the shape that corresponds to the composite tool profile, and wherein the plurality of tool members are accessible through the opening but are limited to being unfolded to the open position through the first open side of the first handle, opposite the floor.

2. A multipurpose tool according to claim 1 wherein the opening is sized to have a width in a direction between the sidewalls perpendicular to the longitudinal axis that is at least as wide as the tool members.

3. A multipurpose tool according to claim 1 further comprising:

first and second jaws rotatably connected to the first and second handles, respectively; and a spring positioned between the first and second jaws and configured to bias the jaws into an open position, wherein the spring is positioned so as to be visible and accessible in an instance in which the first and second handle are in the open position.

4. A multipurpose tool according to claim 1 further comprising:

first and second jaws rotatably connected to the first and second handles, respectively, wherein the first and second jaws comprise respective eccentric cam members; and first and second springs carried by the first and second handles, respectively, that ride upon the eccentric cam members of the first and second jaws, respectively.

5. A multipurpose tool according to claim 4 wherein the eccentric cam members of the first and second jaws each have a first portion that the first and second springs ride upon as the first and second handles transition from the closed position to the open position and a second portion having at least one of a different shape or a different size than the first portion with the first and second springs riding upon the second portion as the first and second handles reach the open position.

6. A multipurpose tool according to claim 1 wherein each tool member comprises a designation representative of the respective tool member, and wherein the designations of the tool members are differently positioned along a longitudinally extending axis of the first handle.

7. A multipurpose tool according to claim 1 wherein the opening defined by the web extending between the opposed sidewalls has the same shape as the composite tool profile.

* * * * *